US005982274A

United States Patent [19]

Stelter et al.

[11] Patent Number: 5,982,274

[45] **Date of Patent: *Nov. 9, 1999**

[54] PAPERLESS PRESSURE AND ALARM RECORDER

[75] Inventors: William F. Stelter, Libertyville; James S. Nasby, Skokie, both of Ill.

[73] Assignee: Master Control Systems, Inc., Lake Bluff, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/442,222

[22] Filed: May 16, 1995

[51] Int. Cl.[6] ..... G08B 13/02

[52] U.S. Cl. ..... 340/286.05; 137/12; 169/61; 73/712; 239/63; 340/626; 346/33 TP; 364/143; 364/146

[58] Field of Search ..... 340/286.05, 626; 364/139, 146, 143; 73/712, 717; 365/118; 169/61, 13; 346/33 TP; 239/63, 67, 69; 137/12

[56] References Cited

U.S. PATENT DOCUMENTS

| | | | |
|---|---|---|---|
| 3,350,931 | 11/1967 | Johnson et al. | 73/712 |
| 3,748,656 | 7/1973 | Gray et al. | 340/626 |
| 5,021,939 | 6/1991 | Puloiese | 364/143 |
| 5,035,357 | 7/1991 | Brickell et al. | 239/63 |
| 5,189,394 | 2/1993 | Walter et al. | 364/146 |
| 5,236,049 | 8/1993 | Asselin et al. | 169/61 |
| 5,373,346 | 12/1994 | Hocker | 346/33 TP |
| 5,460,196 | 10/1995 | Yonnet | 137/12 |

*Primary Examiner*—Daniel J. Wu
*Assistant Examiner*—John Tweel, Jr.
*Attorney, Agent, or Firm*—Jon Carl Gealow

[57] ABSTRACT

A paperless recorder for recording pressure and alarm condition data from a fire controller for a fire pump control system. The fire pump is connected a pipe network which has a pressure sensor for sensing pipe pressure. The recorder is connected to the pressure sensor and checks for pressure changes. When a pressure change is detected, it is stored in an electronic memory. Pressure readings are also periodically stored in the electronic memory. The recorder may also monitor alarm voltages and alarm contacts which may also be stored in the electronic memory. The stored data may be transmitted to a computer via modem or port connection for further analysis.

68 Claims, 4 Drawing Sheets

MASTER CONTROL SYSTEMS, INC.
MODEL PR4000 SPREADSHEET

250

IMPORT DATA AT A6

C7

260 262

| | PSI | CODE | DATE | TIME | -ACTIVE ALARMS (SEE AD36) |
|---|---|---|---|---|---|
| 0032941024140839 | 32 | NA | 10/24/94 | 14:08:39 | |
| 0027941024141016 | 27 | NA | 10/24/94 | 14:10:16 | |
| | | | | 14:10:17 | |
| | | | | 14:10:19 | |
| | | | | 14:10:21 | |
| | | | | 14:10:23 | |
| | | | | 14:10:24 | |
| | | | | 14:10:24 | |
| | | | | 14:10:25 | |
| | | | | 14:10:26 | |
| | | | | 14:10:27 | |
| | | | | 14:10:29 | |
| | 56 | NA | 10/24/94 | 14:10:32 | |
| 0061941024141034 | 61 | NA | 10/24/94 | 14:10:34 | |
| 0056941024141040 | 56 | NA | 10/24/94 | 14:10:40 | |
| 0051941024141041 | 61 | NA | 10/24/94 | 14:10:41 | |
| 0045941024141042 | 45 | NA | 10/24/94 | 14:10:43 | |
| 0040941024141043 | 40 | NA | 10/24/94 | 14:10:43 | |
| 0035941024141044 | 35 | NA | 10/24/94 | 14:10:44 | |
| 0030941024141045 | 30 | NA | 10/24/94 | 14:10:45 | |
| 0025941024141047 | 25 | NA | 10/24/94 | 14:10:47 | |
| 0020941024141048 | 20 | NA | 10/24/94 | 14:10:48 | |
| 0015941024141050 | 15 | NA | 10/24/94 | 14:10:50 | |
| 0010941024141053 | 10 | NA | 10/24/94 | 14:10:53 | |
| 0016941024141053 | 16 | NA | 10/24/94 | 14:10:53 | |
| 0022941024141054 | 22 | NA | 10/24/94 | 14:10:54 | |
| 0027941024141055 | 27 | NA | 10/24/94 | 14:10:55 | |
| 0034941024141056 | 34 | NA | 10/24/94 | 14:10:56 | |
| 0039941024141057 | 39 | NA | 10/24/94 | 14:10:57 | |
| 0044941024141058 | 44 | NA | 10/24/94 | 14:10:58 | |
| 0049941024141059 | 49 | NA | 10/24/94 | 14:10:59 | |
| 0054941024141102 | 54 | NA | 10/24/94 | 14:11:02 | |
| 0059941024141103 | 59 | NA | 10/24/94 | 14:11:03 | |
| 0064941024141103 | 64 | NA | 10/24/94 | 14:11:03 | |
| 0070941024141104 | 70 | NA | 10/24/94 | 14:11:04 | |
| 0076941024141105 | 76 | NA | 10/24/94 | 14:11:05 | |
| 0081941024141105 | 81 | NA | 10/24/94 | 14:11:05 | |
| 0089941024141106 | 89 | NA | 10/24/94 | 14:11:06 | |
| 0095941024141107 | 95 | NA | 10/24/94 | 14:11:07 | |
| 1000941024141108 | 100 | NA | 10/24/94 | 14:11:08 | |
| 0107941024141109 | 107 | NA | 10/24/94 | 14:11:09 | |
| 0102941024141938 | 102 | NA | 10/24/94 | 14:19:38 | |
| 0092941024142803 | 92 | NA | 10/24/94 | 14:28:03 | |
| 0085941024142804 | 85 | NA | 10/24/94 | 14:28:04 | |
| 0079941024142805 | 79 | NA | 10/24/94 | 14:28:05 | |

252 254 256 258

PAPERLESS PRESSURE AND ALARM RECORDER

FIELD OF THE INVENTION

The present invention relates, generally, to the field of recording pressure and alarm conditions for fire pump controllers. More particularly, it relates to a recorder which stores, monitors and provides a record of pressure and alarm conditions sensed from a controller for a fire pump.

BACKGROUND OF THE INVENTION

Fire control systems typically have one or more diesel or electrical fire pumps to boost the water pressure to sprinkler heads attached to the system. Under normal operation, the sprinkler heads do not let water flow and thus the water is under a constant pressure. When a sprinkler head opens, the water pressure in the sprinkler system drops and trips a pressure sensor in a fire pump controller which in turn starts the fire pump so water may be delivered to the sprinkler or sprinklers to extinguish the fire.

The fire pump controller is thus connected to the fire pump to constantly monitor the pressure of the sprinkler system as well as possible alarm conditions from the system. Both during a fire and otherwise, the loss of water pressure and subsequent system pressure readings tell a great deal about the operation of the fire sprinkler system. In fact the monitoring of this data is required by the National Standard For Fire Pumps, NFPA20, which requires a pressure recorder on fire control systems. In the aftermath of the fire, the output recorder is used for evaluating system performance as well as loss analysis. Also, in order to maintain the reliability of the fire control system as well as provide warnings of possible deleterious conditions, the fire pump controller must be able to record pressure and alarm conditions during normal stand-by service. Furthermore, such records must be permanently kept for purposes of safety analysis.

In present systems, a paper recorder is connected to the fire pump controller. Present paper recorders have a plotting pen for recording alarm conditions and pressure data on a paper chart. The paper charts used in pressure recorders require weekly replacement. These recorders also require replacement of ink cartridges. Most recorders require the winding of a seven day chart drive spring movement. Additionally, the seven day charts are typically six inches in diameter which make them difficult to read. Data is typically lost due to a lack of chart replacement, running out of ink, or neglecting to wind the clock movement. Also, the recording may be unreliable as the plotting pens often blur or smudge the record when wide variations of recorded values occur in a relatively short period of time.

Another present method of recording pressure involves periodically printing numeric values on adding machine paper (typically once a minute). This rate is too often during stand-by and far too infrequently during a fire. This method requires paper replacement and also has some of the same problems as the recorder described above.

Finally, present recorders must be located in close proximity to the controller, making analysis and monitoring of fire control systems from remote locations difficult. Often, the paper charts or rolls are lost and with them the system's historical data, making analysis and evaluation impossible.

Thus, a need exists for a paperless recorder to provide a reliable and permanent record of pressure and alarm conditions from fire pump controllers. Further a need exists to provide a recorder which is capable of transmitting data for analysis to a remote location.

SUMMARY OF THE INVENTION

It is an object of this invention to provide a paperless recorder to record pressure and alarm conditions from a fire pump controller. It is a further object of this invention to provide a means to remotely record and analyze pressure and alarm condition data from a fire pump controller. It is another object of the invention to provide a recorder which may be accessed and controlled from a remote location.

In accordance with this invention, a data recorder for a fire control system is disclosed. The fire control system has a pipe network connected to a fire pump and a pressure sensor coupled to the pipe network. The pressure sensor produces a pressure signal representative of the pressure in the pipe network. A controller is connected to the fire pump and pressure sensor.

The data recorder has an input coupled to the controller and the pressure sensor. One of the inputs receives the pressure signal. The data recorder also has an electronic memory capable of storing pressure data. A processor monitors the pressure signal and stores the signal in the form of pressure data in the electronic memory. Additionally, the controller may sense alarm conditions, which are recorded as alarm data in the electronic memory.

The stored pressure data may be transmitted as electronically transmitting data by a data transmitter to a remote location. The data transmitter is coupled to the processor and the electronic memory. An output port provided on the data recorder is coupled to the data transmitter and is adaptable to connection with an external computer.

The processor records pressure readings by taking a pressure reading from the pressure sensor and comparing the pressure reading to a set pressure value. The processor will record the pressure reading in the electronic memory if the absolute value of the difference between the pressure reading and the set pressure value exceeds an allowable change value. The processor will also store pressure readings at periodic time intervals.

The above and other objects, features, and advantages of the present invention will become apparent from the following description with reference to the drawings.

DETAILED DESCRIPTION OF THE PREFERRED EMBODIMENT

Figure 1:
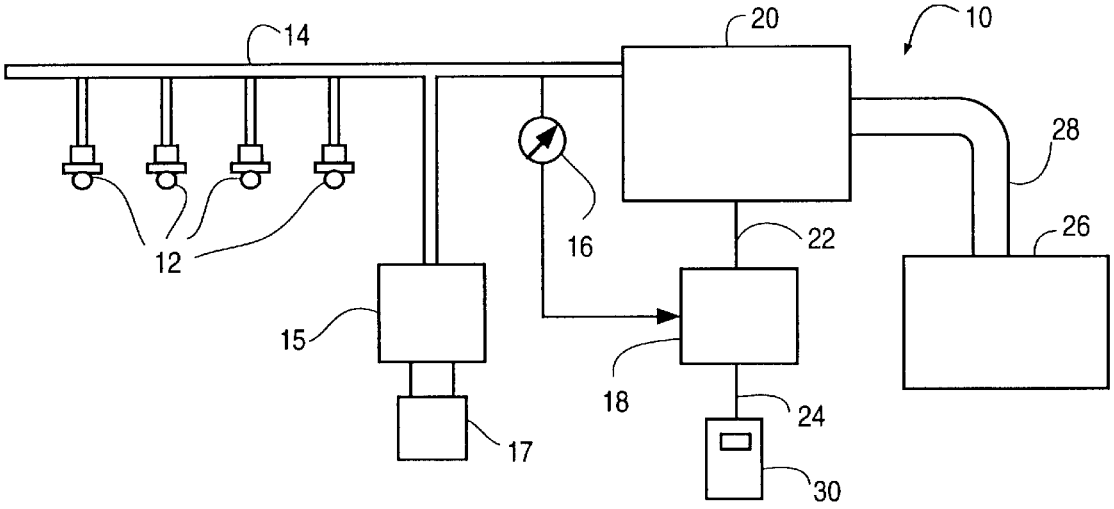
FIG. 1 is a general view of a fire control system with a recorder for the fire pump controller according to the present invention.

FIG. 1 shows a fire control system 10 which may be installed in a factory, dwelling, or office. The fire control system 10 has a series of sprinkler heads 12 which are connected to a pipe network 14. Water pressure is normally maintained by a small make-up (so called "jockey pump")

15 which is connected to a water source 17. The sprinkler heads 12 have a material which is heat sensitive and will melt or rupture in excessive heat conditions causing the water to flow through the sprinkler heads 12. Of course other mechanisms may be used to trigger water flow through the sprinkler heads 12. Once the sprinkler heads 12 open, the water pressure in the pipe network 14 drops. A pressure sensor 16 monitors the water pressure in pipe network 14. The pressure sensor 16 in the preferred embodiment is a strain gauge type transducer with built in amplification. The transducer will normally have a 5 volt span with a 1 volt zero offset. Of course other transducers which sense water pressure may be used for the pressure sensor 16. The output of pressure sensor 16 is coupled to a fire pump controller 18. The pressure sensor 16 may be installed within the fire pump controller 18 or may be external.

The fire pump controller 18 responds to the pressure drop in pipe network 14 sensed by sensor 16 and sends a signal along control/power lines 22 to start a fire pump 20. The fire pump 20 is connected to a water reservoir 26 or to water mains via a supply pipe 28. In response to the signal from the control line 22, the fire pump 20 pumps water from the water reservoir 26 to increase water pressure in the pipe network 14. Once activated, the fire pump 20 increase the pressure in pipe network 14 to force a greater volume of water out of sprinkler heads 12 through the pipe network 14 to combat the fire. Typically, the fire pump 20 may be either diesel or electrically powered.

The fire pump controller 18 is also coupled to a recorder 30 according to the present invention, to record pressure and alarm conditions. The signal sent from the pressure sensor 16 is transmitted through the controller 18. The recorder 30 is coupled to the fire pump controller 18 via an input line 24. With respect to diesel fire pumps, the recorder 30 may be attached directly to or be contained within the controller 18. Of course, the fire pump 20 may pump other flame retardants such as foam if desired.

Figure 2:
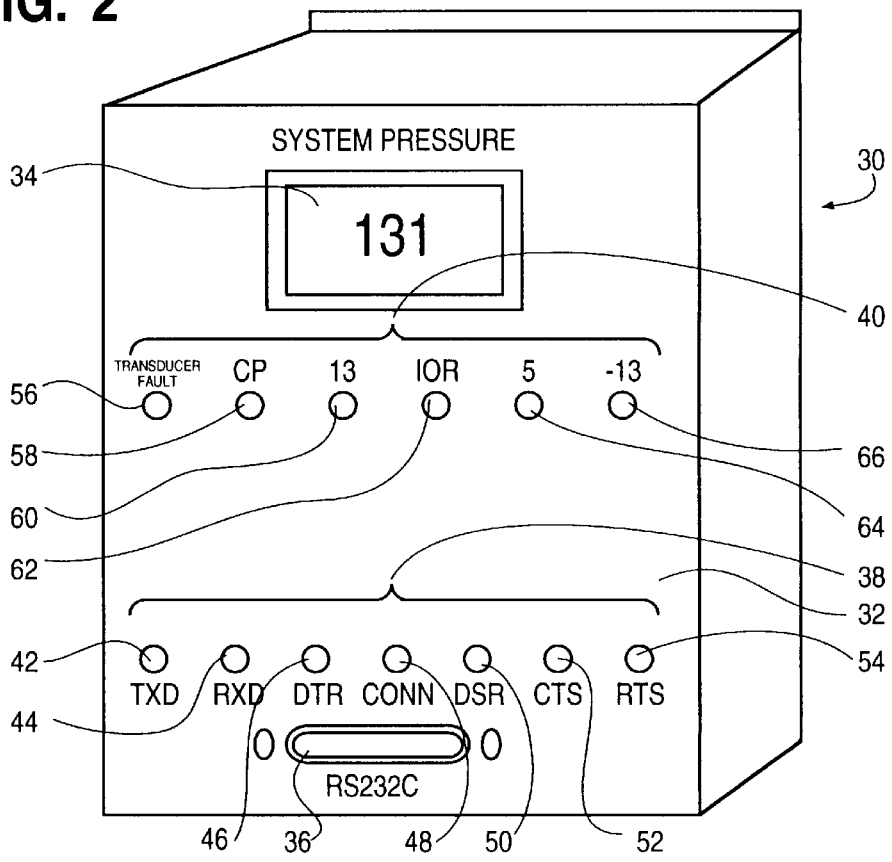
FIG. 2 is a perspective view of the recorder according to the present invention.

FIG. 2 shows a perspective view of the recorder 30 according to the present invention. The recorder 30 has a front panel 32. The front panel 32 has a display 34 which shows the current pressure reading from the pump controller 18. A data connector 36 is also located on the front panel 32. The data connector 36 is a 25-pin RS-232 connector in the preferred embodiments. A series of two banks of light emitting diodes, (LEDs) 38 and 40 are also located on the front face 32 of the recorder 30 to indicate system status and conditions which are present in the operation of recorder 30. Most of the first bank of LEDs 38 are standard modem lamps which includes a transmit data LED 42; a receive data LED 44; a data terminal ready LED 46; a data terminal ready LED 50; a clear to send LED 52; and a ready to send LED 54. A connect LED 48 indicates whether a data connection is present through the output port 36.

The second bank of LEDs 40 includes a transducer fault LED 56, a plus CP LED 58; a positive voltage indicator LED 60, a 10R LED 62; a 5 volt source LED 64; and a negative voltage source LED 66. The transducer fault LED 56 indicates whether the data readings from the pressure sensor 16 are being received correctly. The plus CP LED 58 indicates whether the unregulated power source (typically 24 volts) is connected to the system. The positive voltage LED 60 indicates a 13 volt regulated analog voltage source is connected to the recorder 30. Similarly, the negative voltage LED 66 indicates whether a negative 13 volt regulated analog power source is connected to the recorder 30. The 10R LED 62 indicates whether a 10 volt analog reference voltage is connected to the recorder 30. The 5 volt source LED 64 indicates whether the 5 volt regulated source for the digital power supply is operative.

Figure 3:
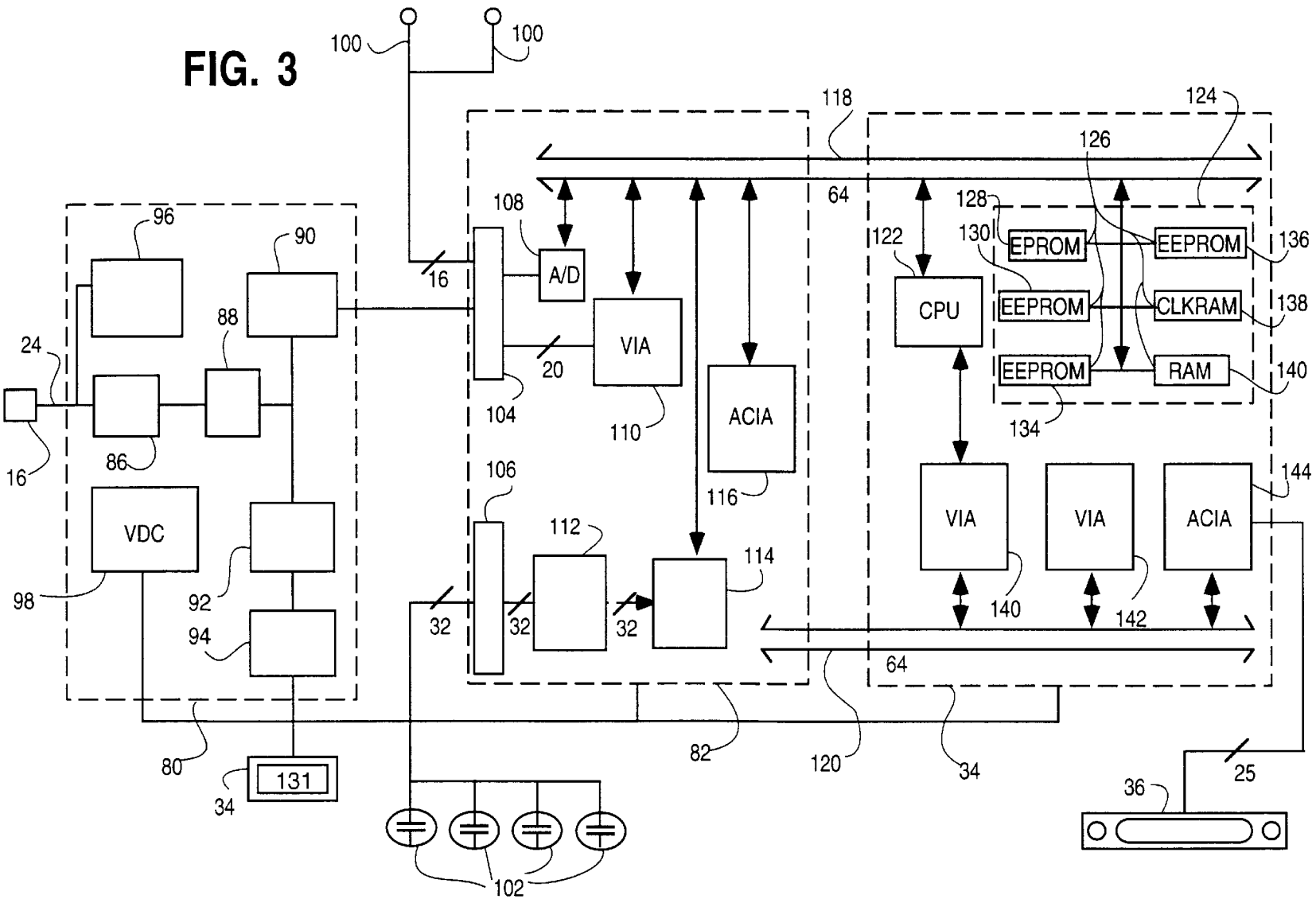
FIG. 3 is a block diagram of the recorder according to the present invention.

FIG. 3 is a block diagram of the recorder 30. The recorder 30 has a pressure input/output block 80, an alarm interface block 82, and a control block 84. In the preferred embodiment, the circuit components contained in pressure input/output block 80, alarm interface block 82, and control block 84 are mounted on three separate printed circuit boards, although other configurations may be used if desired.

The pressure input/output block 80 is directly coupled to the output of pressure sensor 16 via the input line 24. The pressure sensor 16 transmits a signal representing water pressure sensed in the pipe network 14. In the preferred embodiment, this signal is from between one and five volts, although other voltage ranges may be used.

The signal on input line 24 is coupled to a zero adjust circuit 86. The zero adjust circuit 86 decreases the voltage of the signal by one volt. The zero adjust circuit 86 then outputs the signal to a filter 88 which amplifies and filters the pressure signal. The signal is split into two channels. The first channel is connected to a scaler circuit 90 which amplifies the signal to a range of 0 to 5.0 volts. The output of the scaler circuit 90 is an analog signal which is sent to the alarm interface block 82. The second channel is connected to a scaler circuit 92 which scales the signal's voltage range from 0–2 volts. The output of the scaler circuit 92 is connected to a display driver 94.

The display driver 94 converts the voltage signal representing current pressure to a digital signal and provides the reading to display 34. The readout of display 34 is accurate to 2% or 2 digits of a three digit readout. Alternatively, the signal may be connected to an analog to digital converter and the digital output may be displayed in some other manner. The display 34 may also be driven from the system CPU processor in the control block 84. Two separate zero adjust circuits may be coupled to each of the scaler circuits 90 and 92.

The pressure input/output block 80 also contains a sensor monitor 96 which is coupled to the input line 24. The sensor monitor 96 monitors the voltage and current levels from the sensor 16 and drives the transducer fault LED 56 if either voltage or current levels fall outside the sensor's operational ranges.

The pressure input/output block also contains a power supply 98 for the digital and analog components on circuit boards contained in recorder 30. The power supply 98 is contained in a separate enclosure and has a battery as a backup power supply. In the preferred embodiment for use with electric motor drive fire pumps, the power supply is enclosed in a NEMA 12 enclosure with a 120 volt AC power supply. For diesel engine driven pumps, one or both of the engine starting batteries may be used as the source of power. The power supply 98 produces a plus and minus 13 volt regulated power supply for analog components within the recorder 30, a five volt regulated power supply for digital components within the recorder 30, and a 10 volt analog reference signal.

The output signal representing the pressure reading taken from the scaler circuit 90 is transmitted to one of the input connections of an input connector 104. Input connector 104 has a number of other inputs. The input connector 104 also has a number of lines connected to a series of alarm voltage inputs 100 which monitor various alarm lamps in the fire control system 10. In the preferred embodiment, eight alarm lines are coupled to the input connector 104, although more alarm lines may be added. The alarm lamps may include "switch off," "battery failure," "low oil," "high water temperature," "failure to start," charger failure," and "overspeed" indicators. The alarm interface block 82 also has the ability to read up to 32 alarm contact inputs 102. The alarm contact inputs 102 may be installed in fire pump controller 18 or outside the fire controller 18 in other parts of the fire control system. These alarm contacts may include Power Failure, Phases Reversed, Pump Running, and other pump house alarms liked "low pump room temperature," "low fuel," or "low pressure." Up to 32 lines may be connected to the alarm interface block 82 via an input connector 106 in the preferred embodiment. However, additional lines and alarm contacts may be connected with the appropriate hardware.

The analog signal from the pressure input/output block 80 is sent to an analog to digital converter circuit 108 from the input connector 104. The other outputs from the alarm voltage points 100 are input through input connector 104 and connected to a versatile interface adapter (VIA) 110. Similarly, the inputs from the alarm contacts 102 are connected through connector 106 to a series of buffer latches 112 which in turn are connected to a series of optical isolators 114. The alarm interface board 82 also includes an asynchronous communication interface adapter (ACIA) 116.

The output of the optical isolators 114, the VIA 110, the analog digital converter 108 and the ACIA 116 all have addressable locations and are connected to a bus 118 which connects the alarm interface block 82 with the controller block 84. The bus 118 has the capability to transmit data signals, address signals and control signals. A specific address is assigned to the output of the analog to digital converter 108 which corresponds to the pressure readings from the pressure sensor 16. In the preferred embodiment, the analog to digital converter 108 converts analog signals to a 10 bit digital word. The analog to digital converter 108 may be arranged for either unipolar (+10 volts of DC full scale) or bipolar (±5 volts DC). The accuracy is thus better than ±1%.

The VIA 110 is a parallel port interface and is installed as a peripheral chip connected to the bus 118. The VIA 110 reads the analog to digital converter output 108. The VIA 110 serves to monitor local inputs from the alarm voltage inputs 100.

The alarm contacts 102 are input to the alarm interface 82 via the input connector 106. The alarm contacts 102 are optically and electrically isolated from the remainder of the components in the alarm interface block 82 via the optical isolator buffers 112. These signals are then each sent to the series of latches 114 which serve to indicate the status of the alarm contacts 102. In the preferred embodiment octal latches are used for latches 114 and octal optical isolator chips are used for the buffers 112. The data from the alarm contacts 102 are assigned addresses and the outputs of the latches 114 are connected to the bus 118. In the preferred embodiment, the bus 118 assigns sufficient addresses to track at least 32 alarm contacts. Of course larger numbers of the alarm contracts may be monitored if desired, by changing the bus and memory configurations.

The ACIA 116 provides an RS-232 type serial port with a full set of control lines (7 lines). The ACIA 116 is connected to the control block 84 via a second external bus 120 as a data terminal equipment modem device. Also, on board jumpers may configure the serial port as a data communication equipment, data set, or modem device. Thus, alarm and pressure data may be directly transmitted via modem over a standard telephone line to a remote location. DCE port connections are also available on the alarm interface board 82.

The bus 118 is a normal 6502 type microprocessor bus. The bus signals utilized by the present invention include the 8 bi-directional data lines, the lowest 10 address lines, the BPH2+clock signal, and BR/W read/write line. Certain optional functions may utilize the bus reset (BRSE) and masterable interrupt request line (BRQ). Special burst signals include a peripheral address block, (BAP) signal to enable the onboard devices and data transceiver. An auxiliary clock (AXCLK) at 1.8432 Mhz eliminates the need for a clock oscillator circuit on the alarm interface board. A board check (BCHK) signal may be optionally provided which simulates a closure of an alarm test switch and causes reversal of alarm contacts 102. A "Who Are You" (WRU) board identification interrogation signal is required if the recorder 30 is part of a larger network system.

Pseudo vectored interrupt system signals are provided if an Interrupt Identification (IID) register is provided. This configuration allows the alarm interface board 82 to be interrogated by ID strobe read instructions. The alarm interface board 82 sends different IID codes depending on whether the VIA 110 or the ACIA 116 cause the interrupt. A peripheral active (PRA) signal is provided to allow the use of shadow RAM. This signal allows the reading of system RAM, if mapped over the peripheral address space which is read when addressing the latches 114.

The control block 84 is linked to the alarm interface block 82 via the bus 118 and the external data bus 120. The functions of the recorder 30 are controlled via a central processing unit (CPU) 122. In the preferred embodiment the CPU 122 is a Rockwell model 65CO2 microprocessor, although any similar processor such as the Motorola 6800 may be used if appropriate hardware and software adjustments are made. The CPU 122 is coupled to the bus 118 and is able to transmit and receive data and address signals along bus 118. A system memory 124 has six sockets 126 available for memory chips. In the preferred embodiment, sockets 126 have 28 pins.

The six memory sockets 126 may access 8 kilobytes, 16 kilobytes or 32 kilobytes of memory. The lowest socket accepts a static RAM (SRAM) device while the highest socket accepts (ultra violet electrically erasable programmable read only memories) UV-EPROMS. The first and last sockets are always available to all of the memory banks while the remaining sockets may be set to one or more banks and can be set up to receive SRAM or EEPROM devices. By using these various memory banks, the CPU 122 may accept up to 128 kilobytes of memory without having to use memory paging.

In the preferred embodiment, an erasable programmable read only memory (EPROM) 128 is connected to the first memory socket 126. The EPROM 128 is 16 kb in the preferred embodiment. The programs to run the CPU 122 and the operation of recorder 30 are stored in the EPROM 128.

The second, third and fourth memory sockets 126 are connected to electrically erasable programmable read only memories (EEPROM) 130, 134, 136 which are 16 kb in the preferred embodiments. The digitized pressure readings taken from the sensor 16 are stored in the EEPROMs 130, 134, and 136. In the preferred embodiment, the EEPROMs 130, 134, and 136 may store up to 4,000 pressure readings. Once all of the memory is filled, the oldest data is overwritten. Of course larger or smaller EEPROMs may be used if different amounts of data need to be stored. The fifth memory socket 126 is connected to a clock RAM 138 which maintains the clock for the CPU 122. The final memory socket 126 is connected to a RAM chip 140 which is used by the CPU 122 to store operating instructions and data.

The system memory 124 also provides a peripheral address space of one out of 64 blocks of 1024 bytes which may be mapped anywhere in the 64 kilobyte memory space. This peripheral address space is always in all of the memory banks in system memory 124. Local peripherals attached to the control board occupy 64 bytes which leaves 960 bytes of bus connected peripherals. The control board provides a peripheral address block decoded address signal to the bus 118 which eliminates the need for six upper address decoders of the peripheral boards.

The control block 84 also includes a system VIA 140, an external VIA 142, and an ACIA 144 which may be connected by the external bus 120. The CPU 122 also has read only registers (not pictured) such as board answer back, local interrupt ID, non-vectored interrupt IDs, and watch dog flag register.

Each VIA 140 and 142 contains two eight bit parallel ports each having two control ends. The ports may be set to input or output and as can the two control lines. The VIA 140 also controls two 16 bit timers, serial input and output timers, and interrupt provisions. The system VIA 140 is provided as fully accessible on the external bus 120 which serves as an auxiliary peripheral connector. One port of the system VIA 140 is used to monitor and control certain board bus signals from the alarm interface board 82.

The data stored in EEPROMs 130, 134, and 136 may be transmitted to a remote location via the output of the ACIA 144 or the output of ACIA 116. The output from ACIA is a standard RS-232 COM output port 36 in the preferred embodiment but other communications ports may be used such as SCSI. The output 36 may also be coupled to a modem (not pictured) for remote data collection. The modem is a Hayes compatible 9600 baud Smart modem, although other modems may be used if the appropriate hardware and software is configured. The data is sent in a ASCII format so it may be directly imported into software packages such as spreadsheets, databases, or archives.

The CPU 122 of the recorder 30 performs hardware self checks periodically. The EPROM 128 includes a program for providing a coded trouble indication during initialization.

Figure 4:
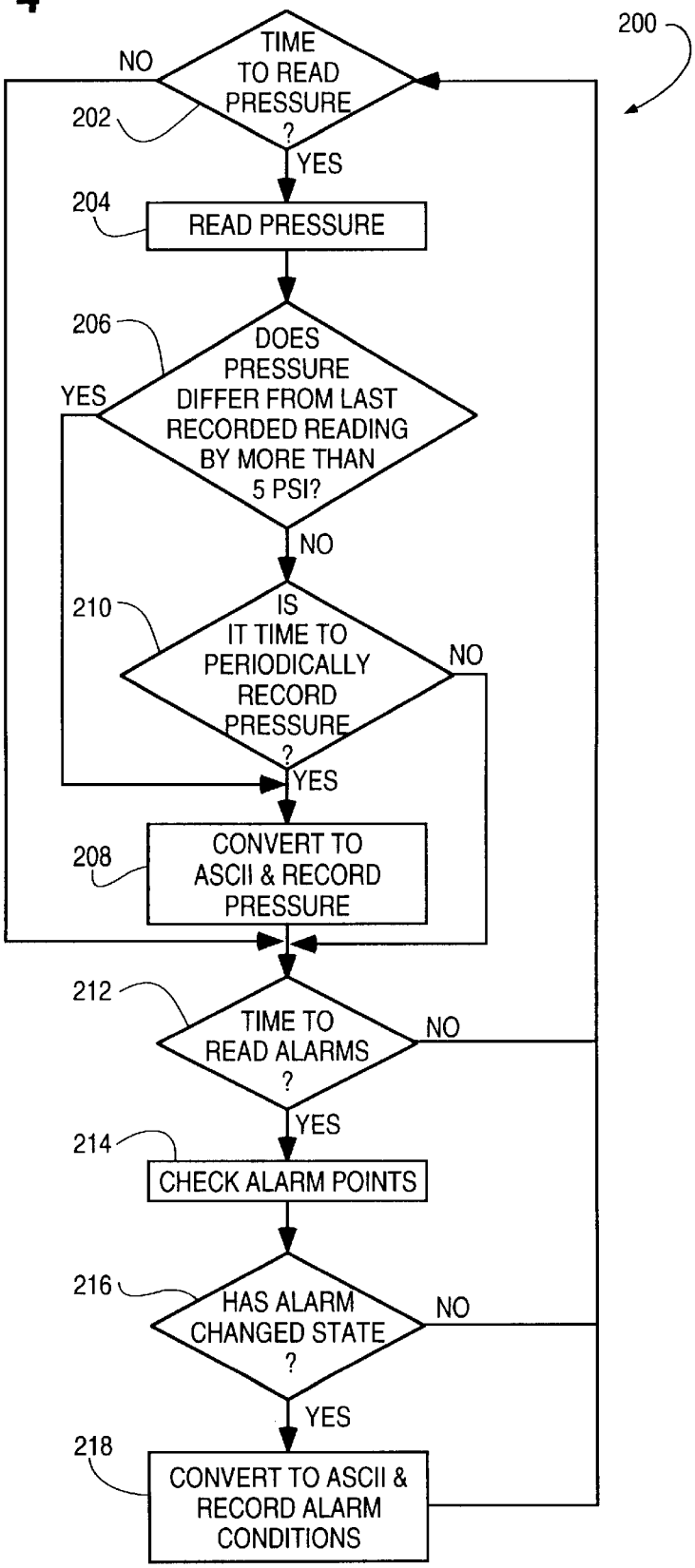
FIG. 4 is a flow diagram of the analysis and recording algorithm of the present invention.

In operation, the pressure is sampled from the fire pump controller 18 at periodic intervals. FIG. 4 shows a flow diagram 200 of the analysis program used by the recorder 30 to record data. The processor determines whether it is time to read the pressure currently in the output of the analog to digital converter 108 in step 202. In the preferred embodiment, the pressure is read at least three times a second although longer or shorter periods may be set. The program will proceed to check alarm conditions as described below even if pressure is not read or recorded. If it is time to read the pressure, the pressure is read in step 204. The pressure reading is then compared to a set pressure value in step 206, and recorded in system memory 124 in step 208 if the reading differs from the set pressure value by more than an allowable change value. In the preferred embodiment, the set value will be the previous recorded pressure reading. The pressure reading will be recorded if it differs from the last recorded reading by more than 5 p.s.i. This value, which determines whether the pressure reading is to be recorded, may be field adjusted according to the specific fire control system requirements. The data is also converted to ASCII format in step 208 for storage in the system memory 124.

Pressure readings are also periodically recorded to system memory 124 according to a set time period in step 210 which is monitored by the CPU 122. For example, pressure readings may be recorded every hour.

After determining whether a pressure should be read or recorded in steps 202 and 208, the processor determines whether it is time to read the pump house and controller alarm points in step 212. A check for these alarm conditions is performed every 10 milliseconds in the preferred embodiment although different time intervals may be used. The alarm points are checked to determine whether they have changed state for pump house and controller alarm in step 214. This data is taken from the alarm contacts 102 and the alarm voltage inputs 100 via the buses 118 or 120. If either a pump house or controller alarm change conditions, it is checked again to determine if the alarm has changed condition in step 216. The data from the alarm points are then converted to ASCII code and recorded in system memory 124 in step 218.

The recorded pressures from step 210 and the pump house and controller alarm points from step 214 are time and date stamped down to a certain time interval of accuracy. The accuracy is determined by a setting stored in the CPU 122 and is typically accurate up to a second. It is to be understood that other data formats may be used for the recorded pressures and alarm conditions if desired. Since the data is stored in non-volatile memory such as the EEPROMS 130, 134, and 136, the data cannot be lost.

The data in ASCII format may be transmitted to an external computer such as a laptop through the RS-232 output 36. The data may be readily converted to applications programs such as spreadsheets, database or archives.

Figure 5:
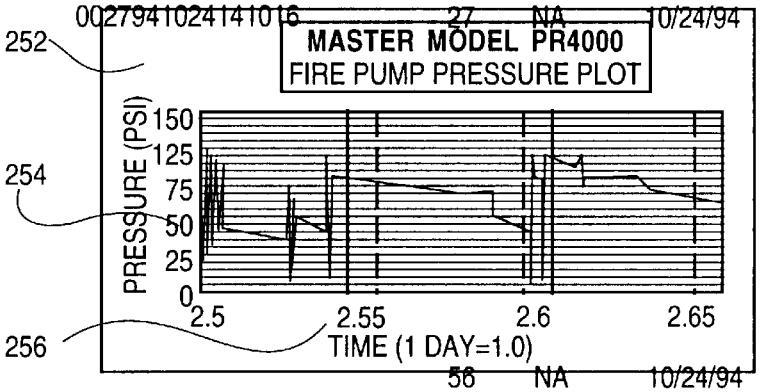
FIG. 5 is a sample readout produced by a spreadsheet program according to the present invention.

FIG. 5 shows a readout 250 of pressure readings against time produced from data recorded in recorder 30 and produced by a Lotus 1-2-3 (tm) spreadsheet program. The readout 250 has a plot 252 having a pressure axis 254 and a time axis 256 superimposed over a data chart 258. A series of pressure data points 260 are graphed on plot 252 as well as recorded on the data chart 158. Each pressure data point 260 has a time and date stamp 262 for traceability. Alarm conditions are also noted in the readout 250.

The appended claims are intended to cover all such changes and modifications which fall in the true spirit and scope of this invention.

We claim:

1. A data recorder for a fire control system having a pipe network connected to a fire pump, a pressure sensor coupled to the pipe network, the pressure sensor producing pressure signals representative of the actual pressure magnitude in the pipe network, said data recorder comprising:

an input coupled to the pressure sensor, said input receiving the pressure signals representative of the actual pressure magnitude in the pipe network;

an electronic memory capable of storing pressure data provided by said pressure signals representative of the actual pressure in the pipe network; and a processor which monitors the pressure signals representative of the actual pressure in the pipe network at first periodic intervals and stores the signals in the form of pressure data in said electronic memory at second periodic intervals, said second periodic intervals being longer than said first periodic intervals.

2. The recorder of claim 1 further comprising:

a data transmission means for electronically transmitting data, said data transmission means coupled to said processor and said electronic memory; and an output port coupled to said data transmission means for providing said data to remote locations.

3. The recorder of claim 2 wherein said data transmission means is an asynchronous communications interface adapter (ACIA) and said output port is an RS-232 connector.

4. The recorder of claim 2 wherein said data transmission means translates data from said electronic memory to an ASCII format.

5. The recorder of claim 2 wherein said output port is connected to a common external personal computer using common personal computer or terminal emulation software.

6. The recorder of claim 1 further comprising:

an alarm contact input coupled to an alarm contact which produces an alarm signal representative of an alarm condition; and a versatile interface adapter (VIA) coupled to said alarm contact input and to said processor and said electronic memory, said versatile interface adapter providing said alarm signal representing said alarm condition to said electronic memory.

7. The recorder of claim 6 wherein said processor further comprises a timing means and wherein said processor stores time data to identify the time of occurrence of said alarm signal in said electronic memory.

8. The recorder of claim 6, further comprising:

a latch coupled to said alarm contact input, said latch receiving said alarm signal; and an optically isolated buffer coupled to said latch, said optically isolated buffer optically isolating said alarm signal and sending said alarm signal to said versatile interface adapter.

9. The recorder of claim 1 wherein said electronic memory includes an electronically erasable programmable read only memory (EEPROM).

10. The recorder of claim 1 further comprising:

a random access memory (RAM) coupled to said processor; and a permanent memory coupled to said processor, said permanent memory storing programs for running said processor.

11. The recorder of claim 1 further comprising:

a modem capable of transmitting data over a phone line; and a second asynchronous communications interface adapter (ACIA) coupled to said modem and said input, said second ACIA translating said pressure signals to data signals and transmitting said data through said modem.

12. The recorder of claim 1 further comprising a display coupled to said input which provides a visual indication of the pressure in the pipe network.

13. A method of recording data from a fire control system having a pipe network, a pressure sensor responsive to absolute pressure coupled to the pipe network, and a pressure recorder coupled to the pressure sensor, the method comprising the steps of:

taking a pressure reading indicative of the actual absolute pressure in the pipe network from the pressure sensor;

comparing said actual absolute pressure reading to a set pressure value; and recording said actual absolute pressure reading in an electronic memory if the absolute value of the difference between said actual absolute pressure reading and said set pressure value exceeds an allowable change value.

14. The method of claim 13 further comprising the step of storing a second actual absolute pressure reading from the pressure sensor at a time interval before taking said actual absolute pressure reading and wherein said set pressure value is said second actual absolute pressure reading.

15. The method of claim 13 further comprising the steps of:

taking additional pressure readings at first periodic time intervals;

storing one of said additional pressure readings in the electronic memory at a relatively longer periodic time interval than the first periodic time interval; and storing a time corresponding to said one of said additional pressure readings in the electric memory.

16. The method of claim 13 further comprising the steps of:

monitoring for the occurrence of alarm conditions in an alarm contact which produces an alarm signal representative of an alarm condition in the fire control system, signified by the occurrence of an event not indicated by the actual pressure magnitude in the pipe network;

storing data indicating an alarm condition upon the occurrence of an alarm condition in the electronic memory; and storing a time corresponding to the occurrence of said alarm condition in the electronic memory.

17. The method of claim 13 further comprising the steps of: translating said stored actual absolute pressure reading into a computer readable format; and transmitting said stored actual absolute pressure through an output to a remote location.

18. The method of claim 17 wherein said output is coupled to a modem.

19. The method of claim 17 wherein said output is through an RS-232 connector.

20. The method of claim 13 wherein said electronic memory includes an electronically erasable programmable read only memory (EEPROM).

21. The recorder of claim 1 further comprising:

an alarm contact input coupled to an alarm contact which produces an alarm signal representative of an alarm condition; and a parallel port adapter coupled to said alarm contact input and to said processor and said electronic memory, said parallel port adapter providing said alarm signal representing said alarm condition to said electronic memory.

22. The recorder of claim 1 further comprising:

a modem capable of transmitting data over a phone line; and a second serial port adapter coupled to said modem and said input, said second serial port adapter translating said pressure signals to data signals and transmitting said data through said modem.

23. A data recorder for use with a fire control system having a pipe network connected to a fire pump, and a pressure sensor coupled to the pipe network for producing an electrical signal representative of the actual pressure magnitude in the pipe network, comprising:

a microprocessor with input means, programming means, timing means, and memory means, said input means receiving said electrical signals representative of the actual pressure in the pipe network, said programming means causing said electrical signal to be acquired by said microprocessor at first periodic intervals determined by said timing means, said programming means causing said microprocessor to compare said acquired electrical signal to an electrical signal representative of a set pressure, said programming means causing said microprocessor to record said acquired electrical signal in said memory means if it differs from said electrical signal representative of a set pressure by more than an allowable difference in pressure, said programming means causing said acquired electrical signal to be acquired by said microprocessor and stored in said memory means at second periodic intervals determined by said timing means, said second periodic intervals being longer than said first periodic intervals, whereby said memory means stores data representative of the actual pressure in the pipe network at first more frequent periodic intervals when the pressure in the pipe network differs by more than an allowable difference in pressure in the first more frequent periodic intervals, and also at second less frequent periodic intervals.

24. The data recorder for use with a fire control system of claim 23, including an analog to digital converter, wherein said pressure sensor provides an analog signal and said analog to digital converter converts said analog signal to a digital signal which is received by said input means.

25. The data recorder for use with a fire control system of claim 23, wherein said microprocessor is provide with at least one contact input which is coupled to at least one alarm contact which produces at least one alarm signal representative of an alarm condition in the fire control system, signified by the occurrence of an event not indicated by the actual pressure magnitude in the pipe network, and a versatile interface adapter (VIA) coupled to said alarm contact input, to said processor, and to said electronic memory, said versatile interface adapter providing said alarm signals representing said alarm conditions to said electronic memory.

26. The data recorder for use with a fire control system of claim 23, wherein said microprocessor is provide with at least one contact input which is coupled to at least one alarm contact which produces at least one alarm signal representative of an alarm condition in the fire control system, signified by the occurrence of an event not indicated by the actual pressure magnitude in the pipe network, and a parallel port adapter coupled to said alarm contact input, to said processor, and to said electronic memory, said parallel port adapter providing said alarm signals representing said alarm conditions to said electronic memory.

27. The data recorder for use with a fire control system of claim 23, wherein said microprocessor is provide with a plurality of alarm contact inputs, each of which is coupled to one of a plurality of alarm contacts each of which produces an alarm signal representative of an alarm condition in the fire control system, each of the alarm conditions signified by the occurrence of an event not indicated by the actual pressure magnitude in the pipe network, and a versatile interface adapter (VIA) coupled to said alarm contact inputs, to said processor, and to said electronic memory, said versatile interface adapter providing said alarm signals representing said alarm condition to said electronic memory.

28. The data recorder for use with a fire control system of claim 23, wherein said microprocessor is provide with a plurality of alarm contact inputs, each of which is coupled to one of a plurality of alarm contacts each of which produces an alarm signal representative of an alarm condition in the fire control system, each of the alarm conditions signified by the occurrence of an event not indicated by the actual pressure magnitude in the pipe network, and a parallel port adapter coupled to said alarm contact inputs, to said processor, and to said electronic memory, said versatile interface adapter providing said alarm signals representing said alarm condition to said electronic memory.

29. The data recorder for use with a fire control system of claim 27, wherein said alarm conditions include one or more of the following, switch off, battery failure, low oil, high water temperature, failure to start, charger failure, overspeed, power failure, phases reversed, pump running, low pump room temperature, low fuel, and oil pressure.

30. The data recorder for use with a fire control system of claim 25, wherein said microprocessor stores time data corresponding to the occurrence of said alarm signal in said electronic memory.

31. The data recorder for use with a fire control system of claim 27, wherein said microprocessor stores time data corresponding to the occurrence of said alarm signals in said electronic memory.

32. The data recorder for use with a fire control system of claim 23, wherein said second periodic interval is several orders of magnitude greater in duration than said first periodic interval.

33. The data recorder for use with a fire control system of claim 23, wherein said first periodic interval is less that one second in duration, and said second periodic interval is in the order of an hour duration.

34. The data recorder for use with a fire control system of claim 23, wherein said first periodic interval is approximately one-third of a second in duration, and said second periodic interval is approximately one hour in duration.

35. The data recorder for use with a fire control system of claim 23, wherein said electrical signal representative of the set pressure is that of the previously recorded acquired electrical signal.

36. The data recorder for use with a fire control system of claim 23, wherein said memory means includes non-volatile memory.

37. The data recorder for use with a fire control system of claim 35, wherein said data representing the actual pressure is stored in said non-volatile memory.

38. The data recorder for use with a fire control system of claim 23, wherein said memory includes read only memory.

39. The data recorder for use with a fire control system of claim 38, wherein operating instructions of said microprocessor are stored in said read only memory.

40. A method for recording data from a fire control system having a pipe network, a pressure sensor coupled to the pipe network for producing an electrical signal representative of the magnitude of the pressure in the pipe network, and a pressure recorder coupled to the pressure sensor, the method comprising the steps of:

acquiring the electrical signal representative of the magnitude of the pressure in the pipe network at first periodic intervals, comparing said acquired electrical signal to an electrical signal representative of a set pressure magnitude, recording said acquired electrical signal in memory if it differs from the electrical signal representative of a set pressure magnitude by more than an allowable difference in pressure magnitude, and recording said acquired electrical signal in memory at second periodic intervals which are longer than said first periodic intervals, whereby data representative of the actual pressure in the pipe network is stored at first more frequent intervals when the pressure in the pipe network differs by more than an allowable difference in pressure magnitude in the first more frequent periodic interval, and also at second less frequent periodic intervals.

41. The method of claim 40, wherein data representative of real time is recorded in memory with each of the recorded acquired electrical signals.

42. The method of claim 40, wherein said second periodic intervals are several orders of magnitude greater in duration than said first periodic intervals.

43. The method of claim 40, wherein said first periodic intervals are less that one second in duration, and said second periodic intervals are in the order of an hour duration.

44. The method of claim 40, wherein said first periodic intervals are approximately one-third of a second in duration, and said second periodic intervals are approximately one hour in duration.

45. The method of claim 40, wherein said electrical signal representative of the set pressure is that of the previously recorded acquired electrical signal.

46. A data recorder for use with a fire control system having a pipe network connected to a fire pump, and a pressure sensor coupled to the pipe network, the pressure sensor producing pressure signals representative of the magnitude of the pressure in the pipe network, said data recorder comprising:

a pressure input/output circuit block receiving the pressure signals from the pressure sensor, said pressure input/output circuit providing an analog signal output representing the magnitude of the pressure in the pipe network, a microprocessor bus, an alarm interface circuit block containing an analog to digital converter, and connected to said microprocessor bus, said alarm interface circuit block receiving the analog signals from the pressure input/output circuit block, and providing digital signals representing the magnitude of the pressure in the pipe network to said microprocessor bus, a control circuit block containing a microprocessor, electronic memory and a versatile interface adapter, the digital signals from said microprocessor bus being supplied to said microprocessor, said microprocessor programmed to receive the digital signal from said microprocessor bus at first periodic intervals, said microprocessor comparing the digital signal to a signal representative of a set pressure, said microprocessor causing the digital signal to be recorded in said electronic memory if it differs from the signal representative of a set pressure by more than an allowable difference, said microprocessor causing said digital signal to be recorded in said electronic memory at a second periodic interval, said second periodic interval being longer than said first periodic interval, whereby data representative of the magnitude of the pressure in the pipe network is recorded at a first more frequent periodic interval when the pressure in the pipe network differs by more than an allowable change in pressure in the first more frequent periodic intervals, and also to be recorded at a second less frequent periodic interval.

47. The data recorder of claim 46, wherein said pressure input/output circuit provides a digital output signal to a visual electronic display for displaying the magnitude of the pressure in the pipe network.

48. The data recorder of claim 46, wherein said alarm interface circuit block contains a versatile interface adapter which receives alarm inputs representing alarm conditions in the fire control system signified by the occurrence of events not indicated by the actual pressure magnitude in the pipe network, and supplies digital signals representative of the alarm inputs to said microprocessor bus.

49. The data recorder of claim 46, wherein said alarm interface circuit block contains a parallel port adapter which receives alarm inputs representing alarm conditions in the fire control system signified by the occurrence of events not indicated by the actual pressure magnitude in the pipe network, and supplies digital signals representative of the alarm inputs to said microprocessor bus.

50. The data recorder of claim 48, wherein said alarm conditions include one or more of the following, switch off, battery failure, low oil, high water temperature, failure to start, charger failure, over-speed, power failure, phases reversed, pump running, low pump room temperature, low fuel, and oil pressure.

51. The data recorder of claim 48, wherein said microprocessor stores time data corresponding to the occurrence of said alarm signal in said electronic memory.

52. The data recorder of claim 46, wherein said alarm interface circuit block contains at least one buffer latch connected to an optical isolator, which buffer latch receives a signal from an alarm contact and which optical isolator provides a signal to said microprocessor bus representing the condition of the alarm contact.

53. The data recorder of claim 46, wherein said electronic memory in said control circuit block for storing the digital signals is non-volatile memory.

54. The data recorder of claim 46, wherein said control circuit block includes random access memory for storing operating instructions for said microprocessor.

55. The data recorder of claim 46, wherein said second periodic interval is several orders of magnitude greater in duration than said first periodic interval.

56. The data recorder of claim 46, wherein said first periodic interval is less that one second in duration, and said second periodic interval is in the order of an hour duration.

57. The data recorder of claim 46, wherein said first periodic interval is approximately one-third of a second in duration, and said second periodic interval is approximately one hour in duration.

58. The data recorder of claim 46, wherein said electrical signal representative of the set pressure is that of the previously recorded acquired electrical signal.

59. The data recorder of claim 58, wherein said data representing the actual pressure is stored in said non-volatile memory.

60. The data recorder of claim 46, wherein said memory includes read only memory.

61. The data recorder of claim 60, wherein operating instructions of said microprocessor are stored in said read only memory.

62. The data recorder of claim 46, wherein data representative of real time is recorded in memory with each of the recorded acquired electrical signals.

63. The data recorder of claim 46, wherein when said electronic memory is full of data representative of the magnitude of the pressure in the pipe network, the oldest data is overwritten by new data representative of the magnitude of the pressure in the pipe network.

64. The data recorder of claim 46, wherein at least 4,000 digital signals representing the magnitude of the pressure in the pipe network may be recorded in said electronic memory.

65. The data recorder of claim 46, wherein said digital signals are recorded in said electronic memory in ASCII format.

66. The data recorder of claim 46, wherein said control circuit block is provided with a data connector which is coupled to said microprocessor bus, whereby the digital signals recorded in said electronic memory is made available for use at remote locations through said data connector.

67. A method of recording data from a fire control system having a pipe network, a pressure sensor coupled to the pipe network, and a pressure recorder coupled to the pressure sensor, the method comprising the steps of:

taking a pressure reading indicative of the actual pressure in the pipe network from the pressure sensor;

comparing said pressure reading to a set pressure value, recording said pressure reading in an electronic memory if the absolute value of the difference between said pressure reading and said set pressure value exceeds an allowable change value taking additional pressure readings at first periodic time intervals;

storing one of said additional pressure readings in the electronic memory at a relatively longer periodic time interval than the first periodic time interval; and storing a time corresponding to said one of said additional pressure readings in the electronic memory.

68. A method of recording data from a fire control system having a pipe network, a pressure sensor coupled to the pipe network, and a pressure recorder coupled to the pressure sensor, the method comprising the steps of:

taking a pressure reading indicative of the actual pressure in the pipe network from the pressure sensor;

comparing said pressure reading to a set pressure value, recording said pressure reading in an electronic memory if the absolute value of the difference between said pressure reading and said set pressure value exceeds an allowable change value monitoring for the occurrence of alarm conditions in an alarm contact which produces an alarm signal representative of an alarm condition in the fire control system, signified by the occurrence of an event not indicated by the actual pressure magnitude in the pipe network;

storing data indicating an alarm condition upon the occurrence of an alarm condition in the electronic memory; and storing a time corresponding to the occurrence of said alarm condition in the electronic memory.

* * * * *

UNITED STATES PATENT AND TRADEMARK OFFICE

CERTIFICATE OF CORRECTION

PATENT NO. : 5,982,274

DATED : November 9, 1999

INVENTOR(S) : William F. Stelter and James S. Nasby

It is certified that error appears in the above-indentified patent and that said Letters Patent is hereby corrected as shown below:

Cancel claims 15 and 16.

Signed and Sealed this

Ninth Day of January, 2001

*Attest:*

Q. TODD DICKINSON

*Attesting Officer*

*Commissioner of Patents and Trademarks*